United States Patent [19]

Belli et al.

[11] Patent Number: 4,911,056

[45] Date of Patent: Mar. 27, 1990

[54] MUSICAL INSTRUMENT

[75] Inventors: Remo D. Belli, North Hollywood; Richard K. Drumm, Palmdale, both of Calif.

[73] Assignee: Remo Inc., Hollywood, Calif.

[21] Appl. No.: 91,930

[22] Filed: Sep. 4, 1987

[51] Int. Cl.[4] ..... G10D 13/08

[52] U.S. Cl. ..... 84/402; 84/422.3

[58] Field of Search ..... 84/402 A, 402 R, 422 H, 84/411 A, 411 R, 402, 422.1, 422.2, 422.3

[56] References Cited

U.S. PATENT DOCUMENTS

| | | | |
|---|---|---|---|
| 3,185,014 | 5/1965 | Ross | 84/422 H |
| 3,742,810 | 7/1973 | Crigger | 84/422 H |
| 4,312,259 | 1/1982 | Henrit | 84/411 A |
| 4,510,838 | 4/1985 | Alexis, Jr. | 84/422 H |

*Primary Examiner*—L. T. Hix
*Assistant Examiner*—Brian W. Brown
*Attorney, Agent, or Firm*—Lyon & Lyon

[57] ABSTRACT

A musical instrument of substantially conical shape that has a rim and spokes, the rim being substantially circular. The spokes number at least three and are of equal length, emanating from a second rim. The second rim is not in the same plane that is defined by the rim but shares the same axis with the first rim. The instrument can be played by striking it with a stick or another instrument. The sound the instrument gives can be changed by varying the diameter of the rim or the number of spokes, the orientation of the instrument, the material of which the instrument is made, or by loosely attaching a cymbal to the interior of the cone defined by the instrument's configuration.

47 Claims, 2 Drawing Sheets

MUSICAL INSTRUMENT

BACKGROUND OF THE INVENTION

There are many instruments which produce musical sounds by being struck by a stick such as drums or the triangle. There are also many instruments that produce musical sounds by striking one against the other such as cymbals or wood blocks. Cymbals can also be struck by a stick to produce a musical tone. The cymbals can either be mounted on a stand and struck or dangled from a string and struck while spinning. Each of these instruments is distinct in the sound produced, as well as the manner in which the desired sound is produced.

Structures similar to the musical instrument disclosed herein have also been used as a support for drum heads. In these instances, the structure is not intended to impart any musical properties to the drum itself. The structure merely acts as a frame on which the drum head is placed and allows the drum head to be tuned.

SUMMARY OF THE INVENTION

A musical instrument comprising a rim and spokes along with a like or different associated device is the object of this invention. The instrument produces the desired sound by being struck by a different or similar object. The musical instrument has a substantially circular configuration with spokes numbering at a minimum three, which extend from a second rim in the center of the outer rim to distinct points on the outer rim. The second rim is not in the same plane as the rim but shares the same axis with the outer rim thereby imparting a substantially conical shape to the instrument. The instrument produces the desired sound by either being struck by another object such as a drum stick or striking two of the instruments together. The sound can be varied by changing the size of the instrument; the number or length of the spokes of the instrument; the material the instrument is made of; by rotating one of the instruments while striking the other instrument; by mounting a cymbal in the instrument; or by striking the instruments together at a different angle.

DESCRIPTION OF THE PREFERRED EMBODIMENTS

Figure 1A:
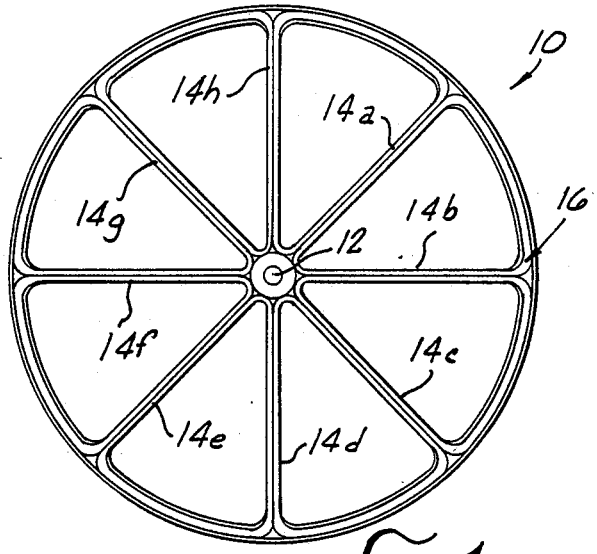
FIG. 1 is a drawing of the instrument, FIG. 1*a* being a top view and FIG. 1*b* being a side view.
Figure 2A:
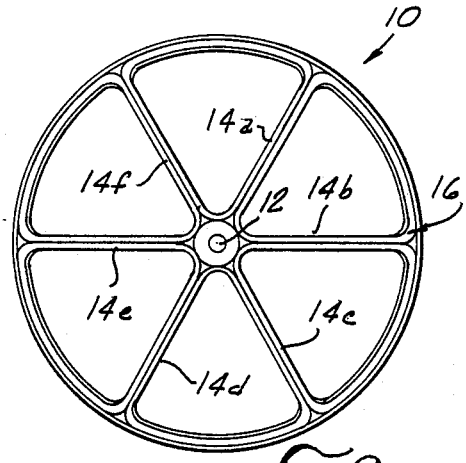
FIG. 2 is a drawing of the instrument with a smaller diameter and fewer spokes than that of FIG. 1, FIG. 2*a* being a top view and FIG. 2*b* being a side view.
Figure 1B:
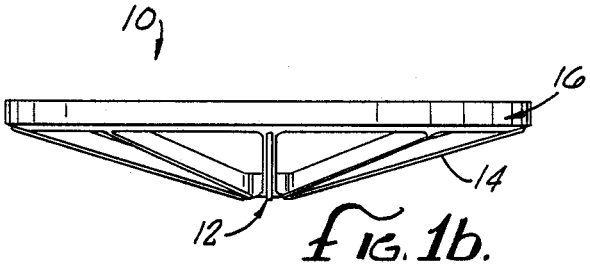
Figure 2B:
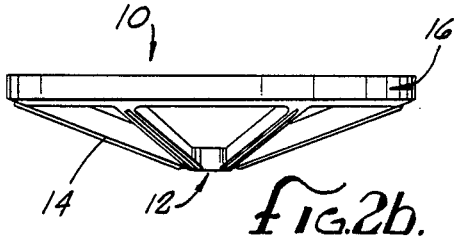

FIGS. 1 and 2 show the basic components of the instrument. FIG. 1 shows a larger diameter embodiment of the component or spider illustrating the spokes 14 and the rim 16. From the figure it can be seen that the rim has a substantially circular configuration. FIG. 1*b* is a side view that shows that the inner rim from which the spokes emanate is not in the same plane as the rim 16. As can be seen in FIG. 1*a* the inner rim is in the center of the outer rim making the spokes 14 all of equal length. However, the spokes can be oriented in an asymmetric fashion, that is the spokes do not have to be equidistant from each other at the points where they intersect the outer rim. FIG. 2 shows the instrument with a smaller diameter and fewer spokes than those shown in FIG. 1. Again, the inner rim 12 from the which the spokes emanate is not in the same plane as the outer rim 16. The component of FIGS. 1 and 2 can be, for example, the spider of a rapid-tuning pitched drum or tuneable tom-tom sold by Remo, Inc. of North Hollywood, Calif. under the Rata Tour name.

Figure 3:
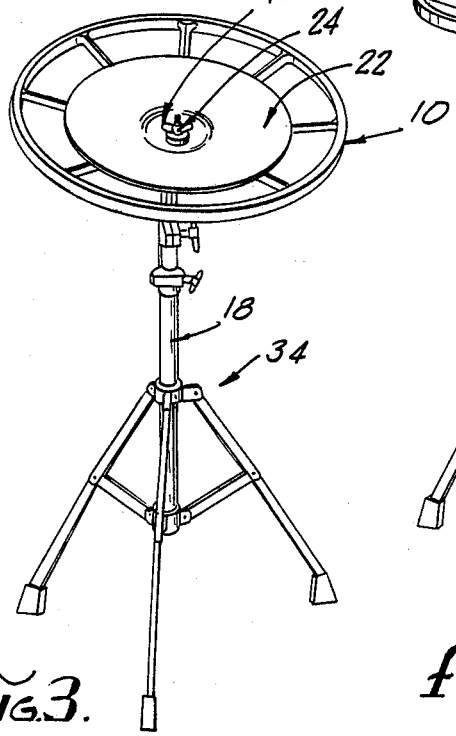
FIG. 3 is a plan view of the instrument mounted on a stand with a cymbal inserted therein.

FIG. 3 shows a first embodiment of the instrument 10 mounted on a stand 34. The instrument is fastened on the shaft 18 using a wing nut 24 assembly or other suitable tightening means. A cymbal 22 is also fastened to the stand 34. The musical instrument 10 imparts a different sound when the cymbal placed therein is struck. The musical instrument also imparts a different sound to the cymbal than if the cymbal were not placed in the instrument. The cymbal 22 is loosely fastened so that when struck it can vibrate or resonate, thereby producing sound. The configuration of the instrument 10 is such that the cymbal can be placed therein. Because of the substantially conical configuration of the instrument 10, the cymbal fits into the instrument although there is an indented portion near the center of the cymbal. This indented portion faces inward toward the inner rim 12 of the instrument.

Figure 4:
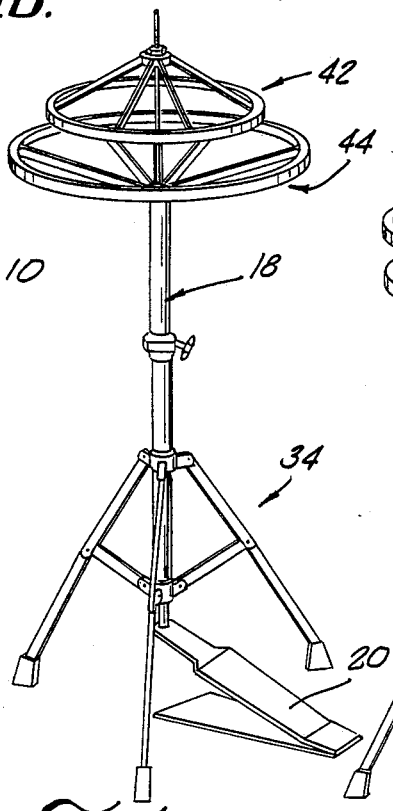
FIG. 4 is a plan view of two instruments of different diameters mounted on a stand facing each other.

FIG. 4 shows yet another embodiment of the invention, a stand with two spiders, 42 and 44, mounted thereon. This stand 34 is equipped with a foot pedal 20. The foot pedal 20 causes one of the instruments 42 to hit against the other instrument 44 when the foot pedal is pressed down. Note that in this embodiment the instruments 42 and 44 have different diameters. By pressing on the foot pedal 20, the top instrument 42 is drawn down to contact the larger stationary instrument 44.

Figure 5:
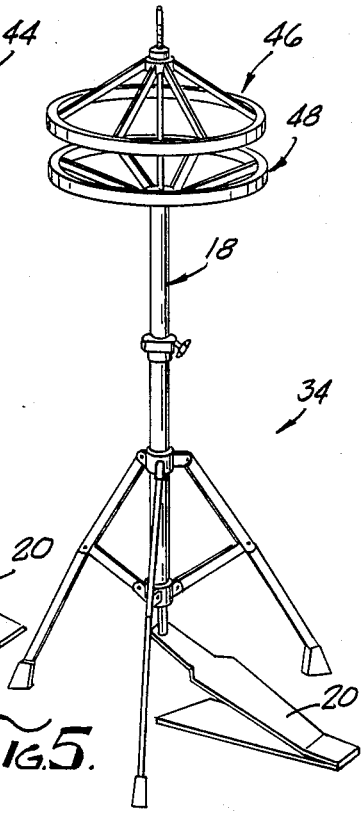
FIG. 5 is a plan view of two instruments of the same diameter facing each other and mounted on a stand.
Figure 6:
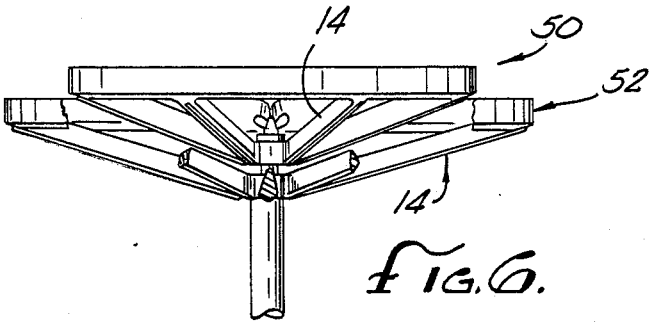
FIG. 6 is a cut-away view showing two instruments flush with each other at their inner rims.

FIG. 5 shows another stand wherein both the instruments 46 and 48 are of the same diameter. Note that FIGS. 4 and 5 show two instruments facing each other with their inner rim portions facing outward. However, it should be noted that the instrument can be mounted where they are facing the same direction as shown in the cut away drawing of FIG. 6. Note that the point where the instruments come into contact with each other in FIG. 6 is the inner rim of instruments 50 and 52.

Figure 7:
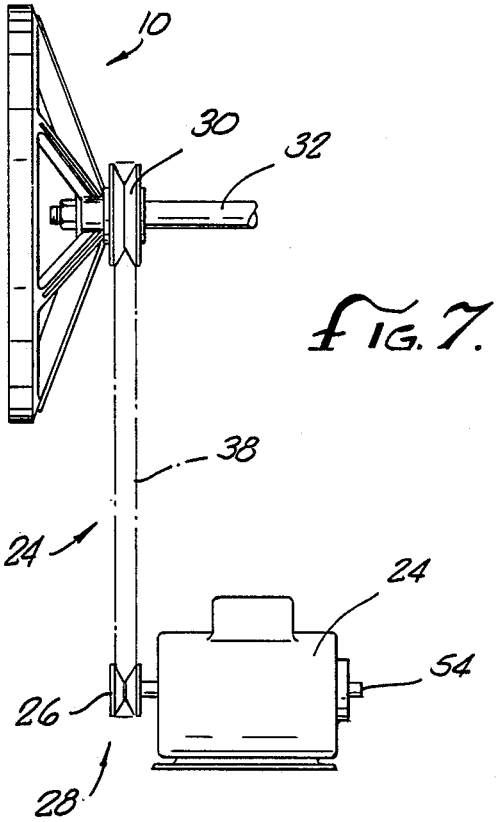
FIG. 7 is a partial view of the instrument with a motor and belt driver mechanism to rotate the instrument while it is being played.

FIG. 7 shows the instrument equipped with a means for rotating it. Rotating the instrument produces a different sort of sound when the instrument is struck either by some sort of stick like a drum stick or another instrument. The instrument is rotated by the motor 24 rotating the shaft 54 of the motor to which a pulley 26 is attached. The pulley 26 has a belt 28 which also wraps around a pulley 30. As the shaft 54 turns it rotates pulleys 26 and 30. Pulley 30 is attached to a shaft 32 which is attached to the instrument 10. The shaft 32 as depicted in FIG. 7 is rotatably mounted in the stand 34 depicted in FIG. 3. As wheel 30 rotates so does shaft 32 and the attached instrument 10, and, when struck, creates a Doppler effect.

Note that FIG. 7 shows the instrument mounted so that the face of the instrument is facing sideways rather than upward or downward. Tonal variation is available by playing the instrument at an angle.

It should be noted that the embodiment depicted in FIGS. 4 through 7 can be modified by placing a cymbal inside the instruments as depicted in FIGS. 4–7 (Instruments 10, 42, 44, 46, 48, 50 and 52), the cymbals are placed in the instrument in an orientation as depicted in FIG. 3. When a pair of instruments is to be struck together to make a sound, a cymbal can be placed in either one or both of the instruments, depending upon the desired sound. Of course, the instruments can also be used without the cymbal therein, as depicted on FIGS. 4–7. By placing cymbals in the instruments depicted in FIGS. 4–7, the sound made by these instruments when struck together can be varied.

The preferred material of which the instrument is made of is cast aluminum. An obvious modification for one skilled in the art would be to make the instrument of any metal or other material with adequate resonant properties when cast in this or similar configuration. Another obvious modification to one skilled in the art would be that a portion of an instrument with the same or similar configuration would possess similar musical properties. Therefore, a fragment of the instrument shown in the drawings can be employed in the same manner as the entire instrument as described herein.

The embodiments described herein are for purposes of illustration only and are not intended to limit the scope of the invention in any way except in the spirit of the appended claims.

What is claimed is:

1. A musical instrument which is played by striking it comprising:

a substantially circular, metallic outer rim;

at least four metallic spokes with a first end and a second end, each spoke with the first end attached to an inner rim that shares a common axis with the substantially circular outer rim, the second end of each spoke being attached to the outer rim at separate and distinct points on the outer rim;

attachment means provided by the inner rim of the instrument;

wherein the inner rim is in a different plane than that defined by the outer rim so that the instrument has a substantially conical configuration; and a cymbal with the substantially conical configuration loosely attached to the inner rim by the attachment means, the cymbal oriented such that the narrower portion of the cymbal is facing toward and nearest to the inner rim of the instrument.

2. The musical instrument of claim 1 wherein at least two of the musical instruments are hit one against the other to make a sound.

3. The musical instrument of claim 1 wherein the instrument is mounted on a stand comprising:

a first shaft which slidably fits through the attachment means a bore being provided therethrough;

a means for securing the instrument on the shaft; and a base which enables the instrument and stand combination to be free standing on a flat surface.

4. The stand of claim 3 further comprising a pedal with the first position and a second position attached to a second, longer shaft which fits slidably into the first shaft; a means for tightening an instrument to the second shaft; the instrument on the second shaft contacting the instrument on the first shaft when the pedal is in the second position.

5. The musical instrument of claim 4 wherein the instruments are mounted facing each other with their inner rims facing outward.

6. The musical instrument of claim 4 wherein the instruments are mounted on the shafts so that the inner rims are facing each other with the outer rims facing outward.

7. The musical instrument of claim 4 wherein the instruments are mounted on the shaft so that the inner rim of one instrument is facing the outer rim of the other instrument.

8. The musical instrument of claim 1 wherein the instrument further comprises a means to rotate the instrument radially about its common axis.

9. The musical instrument of claim 1 wherein the rim are not parallel to the ground when the instrument is struck.

10. The musical instrument of claim 4 wherein the stand further comprises a means for spinning the instrument radially by spinning the shaft on which the instrument is mounted.

11. The musical instrument of claim 10 wherein the means for spinning the instrument comprises a motor; an axle which is turned by the motor; pulley attached to the axle; a second pulley attached to one of the shafts of the stand to which an instrument is secured; and a belt that wraps around bath pulleys, causing the second pulley to turn when the first pulley turns.

12. The musical instrument of claim 3 wherein the shaft to which the instrument is attached is further attached to a bracket which is attached to a rotatably adjustable tightening means which allows the shaft and the instrument attached thereto to be oriented at an angle that varies from the vertical.

13. The musical instrument of claim 2 wherein the instruments have the same diameter.

14. The musical instrument of claim 2 wherein the instruments have different diameters.

15. The musical instrument of claim 1 wherein the metallic rim and spokes are made of cast aluminum.

16. The musical instrument of claim 1 wherein the instrument is severed and a fragment thereof is used to make the required sound.

17. A musical instrument which is played by striking it, comprising:

a substantially circular, metallic outer rim;

at least three metallic spokes with a first and a second end, each spoke having their first end attached to an inner rim that shares a common axis with the substantially circular outer rim and the second end of each spoke being attached to the outer rim at separate and distinct points on the outer rim;

attachment means provided by the inner rim of the instrument;

the inner rim being in a different plane than the plane defined by the outer rim so that the instrument has a substantially conical configuration; and a rotating means for spinning the instrument about the common axis to enable the instrument to be spinning when struck.

18. The musical instrument of claim 17 wherein two instruments are hit together to make a sound.

19. The musical instrument of claim 17 wherein the instrument is mounted on a stand comprising:

a first shaft which slidably fits through a bore in the attachment means;

a means for securing the instrument on the shaft; and a base which enables the instrument and stand combination to be free standing on a flat surface.

20. The stand of claim 17 further comprising a pedal with a first position and a second position attached to a second, longer shaft which fits slidably into the first shaft; a means for tightening an instrument to the second shaft; the instrument on the second shaft contacting the instrument on the first shaft when the pedal is in the second position.

21. The musical instrument of claim 20 wherein the instruments are mounted facing each other with their inner rims facing outward.

22. The musical instrument of claim 20 wherein the instruments are mounted on the shafts so that the inner rims are facing each other with the outer rims facing outward.

23. The musical instrument of claim 20 wherein the instruments are mounted on the shaft so that the inner rims of one instrument is facing the outer rim of the other instrument.

24. The musical instrument of claim 17 wherein a cymbal is loosely attached to the inner rim by the attachment means.

25. The musical instrument of claim 17 wherein the rim is not parallel to the ground when the instrument is struck.

26. The musical instrument of claim 20 wherein the means for spinning the instrument comprises a motor; an axle which is turned by the motor; a pulley attached to the axle; a second pulley attached to one of the shafts of the stand to which an instrument is secured; and a belt that is attached to both the first and second pulleys, causing the second pulley to turn when the first pulley turns.

27. The musical instrument of claim 19 wherein the shaft to which the instrument is attached is further attached to a bracket which is attached to a rotatably adjustable tightening means which allows the shaft and the instrument attached thereto to be oriented at an angle that varies from the vertical.

28. The musical instrument of claim 18 wherein the instruments have the same diameter.

29. The musical instrument of claim 18 wherein the instruments have different diameters.

30. The musical instrument of claim 17 wherein the metallic rim and spokes are made of cast aluminum.

31. The musical instrument of claim 17 wherein the instrument is severed and a fragment thereof is used to make the required sound.

32. A musical instrument which is played by striking a first part against a second part, each part, comprising:

a substantially circular, metallic outer rim;

at least four metallic spokes with a first and a second end, each spoke having their first end attached to an inner rim that shares a common axis with the substantially circular outer rim and the second end of each spoke being attached to the outer rim at separate and distinct points on the outer rim;

attachment means provided by the inner rim of the instrument;

the inner rim being in a different plane than the plane defined by the outer rim so that the instrument has a substantially conical configuration.

33. The musical instrument of claim 32 wherein the instruments is struck with a second musical instrument of claim 32 to make a sound.

34. The musical instrument of claim 32 wherein the instrument is mounted on a stand comprising:

a first shaft which slidably fits through a bore in the attachment means;

a means for securing the instrument on the shaft; and a base which enables the instrument and stand combination to be free standing on a flat surface.

35. The stand of claim 32 further comprising a pedal with a first position and a second position attached to a second, longer shaft which fits slidably into the first shaft; a means for tightening an instrument to the second shaft; and instruments being secured on the second shaft and the first shaft, the instruments contacting each other when the pedal is in the second position.

36. The musical instrument of claim 35 wherein the instruments are mounted facing each other with their inner rims facing outward.

37. The musical instrument of claim 35 wherein the instruments are mounted on the shafts so that the inner rims are facing each other with the outer rims facing outward.

38. The musical instrument of claim 35 wherein the instruments are mounted on the shaft so that the inner rim of one instrument is facing the outer rim of the other instrument.

39. The musical instrument of claim 34 wherein a cymbal is loosely attached to the inner rim by the attachment means.

40. The musical instrument of claim 35 wherein the instruments have the same diameter.

41. The musical instrument of claim 35 wherein the instruments have different diameters.

42. The musical instrument of claim 32 wherein the metallic rim and spokes are made of cast aluminum.

43. The musical instrument of claim 32 wherein the instrument is severed and a fragment thereof is used to make the required sound.

44. A method for making a sound comprising:

striking a musical instrument comprising: a substantially circular, metallic outer rim; at least four metallic spokes with a first end and a second end, each spoke with the first end attached to an inner rim that shares a common axis with a substantially circular outer rim, the second end of each spoke being attached to the outer rim at separate and distinct points on the outer rim; an attachment means provided with the inner rim of the instrument; wherein the inner rim is in a different plane than the outer rim so that the inner rim has a substantially conical configuration; and a cymbal with a substantially conical configuration loosely attached to the inner rim by an attachment means, the cymbal oriented such that the narrower portion of the cymbal is facing toward and nearest to the inner rim of the instrument.

45. The method of claim 43 in which the musical instrument is struck by a second identical instrument.

46. The method of claim 43 in which the musical instrument is struck by a cymbal.

47. The method of claim 43 in which the musical instrument is struck by a frame-type cymbal with the first rim and a second rim, said rims being in different planes but having a common axis and connected by at least four spokes; said first rim being substantially smaller in diameter than said second rim, imparting a substantially conical configuration to said frame-type cymbal.

* * * * *

UNITED STATES PATENT AND TRADEMARK OFFICE

CERTIFICATE OF CORRECTION

PATENT NO. : 4,911,056

DATED : March 27, 1990

INVENTOR(S) : Remo D. Belli and Richard K. Drumm

It is certified that error appears in the above-identified patent and that said Letters Patent is hereby corrected as shown below:

On the title page item [75]:

Inventor: Richard K. Drumm

Delete incorrect reference to inventor Remo D. Belli

Heading of cover page:

[75] Inventors: Remo D. Belli, North Hollywood;

Signed and Sealed this

Fifth Day of May, 1992

*Attest:*

DOUGLAS B. COMER

*Attesting Officer*

*Acting Commissioner of Patents and Trademarks*